US010010183B2

(12) United States Patent
DeMore et al.

(10) Patent No.: US 10,010,183 B2
(45) Date of Patent: Jul. 3, 2018

(54) ADJUSTABLE CUSHION DEVICE

(71) Applicant: Enduring Wellness, LLC, Cleveland, OH (US)

(72) Inventors: Anthony DeMore, Willoughby, OH (US); Brian Sokol, Vermillion, OH (US); Rene Polin, Highland Heights, OH (US); Jason Cooper, Lyndhurst, OH (US)

(73) Assignee: ENDURING WELLNESS, LLC, Cleveland, OH (US)

( * ) Notice: Subject to any disclaimer, the term of this patent is extended or adjusted under 35 U.S.C. 154(b) by 0 days.

(21) Appl. No.: 15/492,347

(22) Filed: Apr. 20, 2017

(65) Prior Publication Data

US 2017/0303689 A1 Oct. 26, 2017

Related U.S. Application Data

(60) Provisional application No. 62/325,075, filed on Apr. 20, 2016.

(51) Int. Cl.

| | |
|---|---|
| ***A47C 7/42*** | (2006.01) |
| ***A47C 7/48*** | (2006.01) |
| ***A47G 9/10*** | (2006.01) |

(52) U.S. Cl.

CPC ..... *A47C 7/425* (2013.01); *A47C 7/48* (2013.01); *A47G 9/10* (2013.01); *A47G 2009/1018* (2013.01)

(58) Field of Classification Search

CPC ..... A47G 9/10; A47G 9/1081; A47G 2009/1018; A47C 7/383; A47C 7/48; A47C 7/425

See application file for complete search history.

(56) References Cited

U.S. PATENT DOCUMENTS 3,601,121 A * 8/1971 Roberts ..... 5/633
3,719,185 A * 3/1973 Hanes ..... A47G 9/10 5/630
4,756,035 A * 7/1988 Beier ..... A47G 9/1081 5/640

(Continued)

FOREIGN PATENT DOCUMENTS

DE 102013015583 A1 * 3/2015 ..... A47G 9/10

*Primary Examiner* — Eric J Kurilla

(74) *Attorney, Agent, or Firm* — Medley, Behrens & Lewis, LLC

(57) ABSTRACT

This disclosure relates to a cushion and more particularly to a pillow providing cervical alignment by way of a cervical spine support structure that is positioned along a major axis of the pillow, and that can be rotated around the major axis. The pillow utilizes one or more of the following features: 1) a dimensionally correct platform for the proper sleep posture of a majority of body types on a wide array of mattress types; 2) A non-crush zone integrated cervical support roll which can be adjusted for extended durations of supportive comfort. (The roll—in and of itself—is unique compared to the standard of care because of its foam densities and its semi-hollowed out section); and 3) A sleep posture platform with a side sleeping position and a back-sleeping position. The pillow standardizes care by placement of the support roll inside a dimensionally correct platform using different materials.

20 Claims, 8 Drawing Sheets

(56) References Cited

U.S. PATENT DOCUMENTS 4,829,614 A * 5/1989 Harper ..... A47G 9/1081 5/636
4,916,765 A * 4/1990 Castronovo, Jr. .... A47G 9/1081 297/284.1
5,168,590 A 12/1992 O'Sullivan
5,367,731 A 11/1994 O'Sullivan
5,371,909 A * 12/1994 McCarty ..... A47D 13/08 5/490
5,533,218 A * 7/1996 Fahy ..... A47C 27/144 5/421
5,545,199 A * 8/1996 Hudson ..... A47G 9/1036 5/421
5,682,633 A * 11/1997 Davis ..... A47G 9/1081 5/636
D400,387 S * 11/1998 Denney ..... D6/601
6,360,388 B2 * 3/2002 Langer ..... A61G 7/0755 5/490
6,449,788 B1 * 9/2002 Nichols ..... A47C 20/021 5/630
6,490,743 B1 12/2002 Adat et al.
6,513,179 B1 * 2/2003 Pan ..... A47G 9/109 5/636
6,823,546 B1 * 11/2004 Hsu ..... A47G 9/007 5/636
7,461,424 B2 12/2008 Lindell
2003/0045824 A1 * 3/2003 Murphy ..... A61F 5/01 602/32
2005/0198738 A1 * 9/2005 Hedges ..... A47G 9/1081 5/636
2008/0256711 A1 * 10/2008 Wallis ..... A47C 31/005 5/639
2013/0119716 A1 * 5/2013 Stronconi ..... A47C 20/02 297/180.1
2015/0096124 A1 * 4/2015 Yu ..... A47G 9/1081 5/640
2015/0173516 A1 * 6/2015 Erbe ..... A47C 7/383 5/636
2016/0278553 A1 * 9/2016 Biebl ..... A47G 9/1081
2017/0143254 A1 * 5/2017 Bell ..... A61B 5/11
2017/0251841 A1 * 9/2017 Loos ..... A47G 9/10
2017/0280902 A1 * 10/2017 Chan ..... A47C 7/383
2018/0014667 A1 * 1/2018 Ibrahim ..... A47G 9/10
2018/0064253 A1 * 3/2018 DeMore ..... A47C 7/425
2018/0103766 A1 * 4/2018 Ou ..... A47C 7/62

* cited by examiner

ADJUSTABLE CUSHION DEVICE

RELATED APPLICATIONS

This application claims priority to U.S. Provisional Patent Application No. 62/325,074, filed on Apr. 20, 2016, and entitled "ADJUSTABLE CUSHION DEVICE", the entirety of which is incorporated herein by reference.

FIELD

The present disclosure relates to a cushion and more particularly to a pillow.

BACKGROUND

Various devices exist that are intended for use in aligning the cervical spine. For example, McKenzie rolls that can be placed under or inside conventional pillows are prescribed to aid in alignment of the cervical spine. However, since physicians often do not know what type of pillow a McKenzie roll will be placed under, or in, dimensions of a prescribed McKenzie roll may be poorly suited to cervical spine alignment of an individual patient. There are multiple pillows in the marketplace that claim to align the cervical spine. But because of the variabilities in end-user physiology, material selections, sleep position preference, mattress firmness, and personal comfort preferences, no one pillow exists that offers true customization to solve the problem of cervical spine alignment for a wide range of consumers.

SUMMARY

The following is a brief summary of subject matter that is described in greater detail herein. This summary is not intended to be limiting as to the scope of the claims.

The present disclosure relates to a cushion and more particularly to a pillow providing cervical alignment by way of an adjustable cervical spine support structure that is positioned along a major axis of the pillow, and that can be rotated around the major axis. The adjustable cervical spine support can have two or more segments having different material properties or different geometries. When the adjustable cervical spine support is rotated around the major axis, a level of support provided by the pillow changes based upon an alignment of the segments of the adjustable cervical spine support with respect to a surface of the pillow. The pillow can further be configured to have surface portions of differing densities such that greater support is provided for a user's cervical spine. In addition, the adjustable cervical support gains additional efficacy by being integrated with a specific geometry for the back sleeping position and a specific geometry for a side sleeping position. As such, in embodiments, the pillow is further differentiated from prior cushion devices by having two dimensionally correct platforms in one pillow—a side sleeping platform and a back sleeping platform.

The above summary presents a simplified summary in order to provide a basic understanding of some aspects of the devices and/or methods discussed herein. This summary is not an extensive overview of the devices and/or methods discussed herein. It is not intended to identify key/critical elements or to delineate the scope of such devices and/or methods. Its sole purpose is to present some concepts in a simplified form as a prelude to the more detailed description that is presented later.

DETAILED DESCRIPTION

Figure 1:
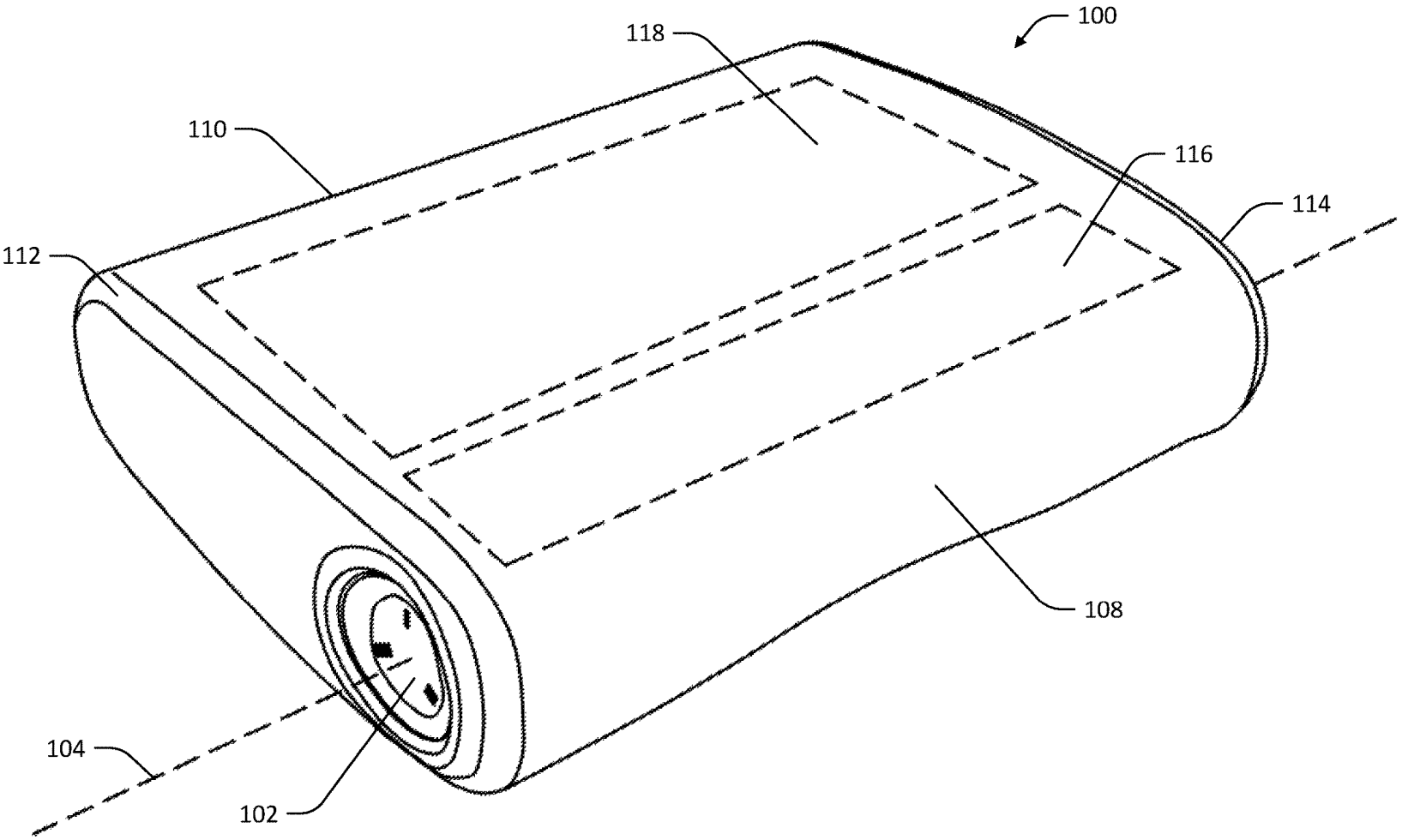
FIG. 1 is a perspective view of an example adjustable pillow.

Various technologies pertaining to an adjustable cushion are now described with reference to the drawings, wherein like reference numerals are used to refer to like elements throughout. In the following description, for purposes of explanation, numerous specific details are set forth in order to provide a thorough understanding of one or more aspects. It may be evident, however, that such aspect(s) may be practiced without these specific details.

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Additionally, as used herein, the term "exemplary" is intended to mean serving as an illustration or example of something, and is not intended to indicate a preference.

The present disclosure relates to a cushion and more particularly to a pillow providing cervical alignment by way of an adjustable cervical spine support structure that is positioned along a major axis of the pillow, and that can be rotated around the major axis. In an embodiment, the cervical spine support may also be fixed and not adjustable. The pillow disclosed herein is further differentiated by its integration into a dimensionally correct pillow geometry and a platform that is specific to a back sleeper and a side sleeper.

FIG. 1 shows an example adjustable pillow 100 with an adjustment knob 102 disposed along a major axis 104 of the pillow 100. The adjustment knob 102 is coupled to an adjustable cervical spine support 106 (not shown). The adjustment knob 102 can be used to adjust a firmness of at least a portion of the pillow 100 in order to aid in alignment of a user's cervical spine. In exemplary embodiments, the adjustment knob can comprise a soft yet stiff material, such as a foam or rubber material. The adjustment knob 102 can include a protruding center portion that can be grasped by a user in order to twist the knob 102 and thereby adjust the adjustable cervical spine support 106. The adjustable pillow 100 is designed to account for variabilities in end-user physiology, sleep position preference, mattress firmness, and personal comfort preferences. The pillow 100 is ergonomically shaped, e.g. with rounded ends 108, 110, and edges 112, 114.

In the embodiment of FIG. 1, the pillow 100 is ergonomically shaped for accommodating a user's neck being rested on a lower pillow surface 116, which is above the adjustable cervical spine support 106. The pillow 100 is also ergonomically configured to accommodate a user's skull to rest against an upper pillow surface 118. In this embodiment, the adjustable cervical spine support 106 and the major axis 104 is located offset from the center of the pillow toward the lower end 108 of the pillow 100 as depicted in FIG. 1. For example, the major axis 104 may be within 1.5 to 4 inches of the lower end of the pillow, such as 2 to 3.75 inches, or 2.5 to 3.5 inches.

Figure 2:
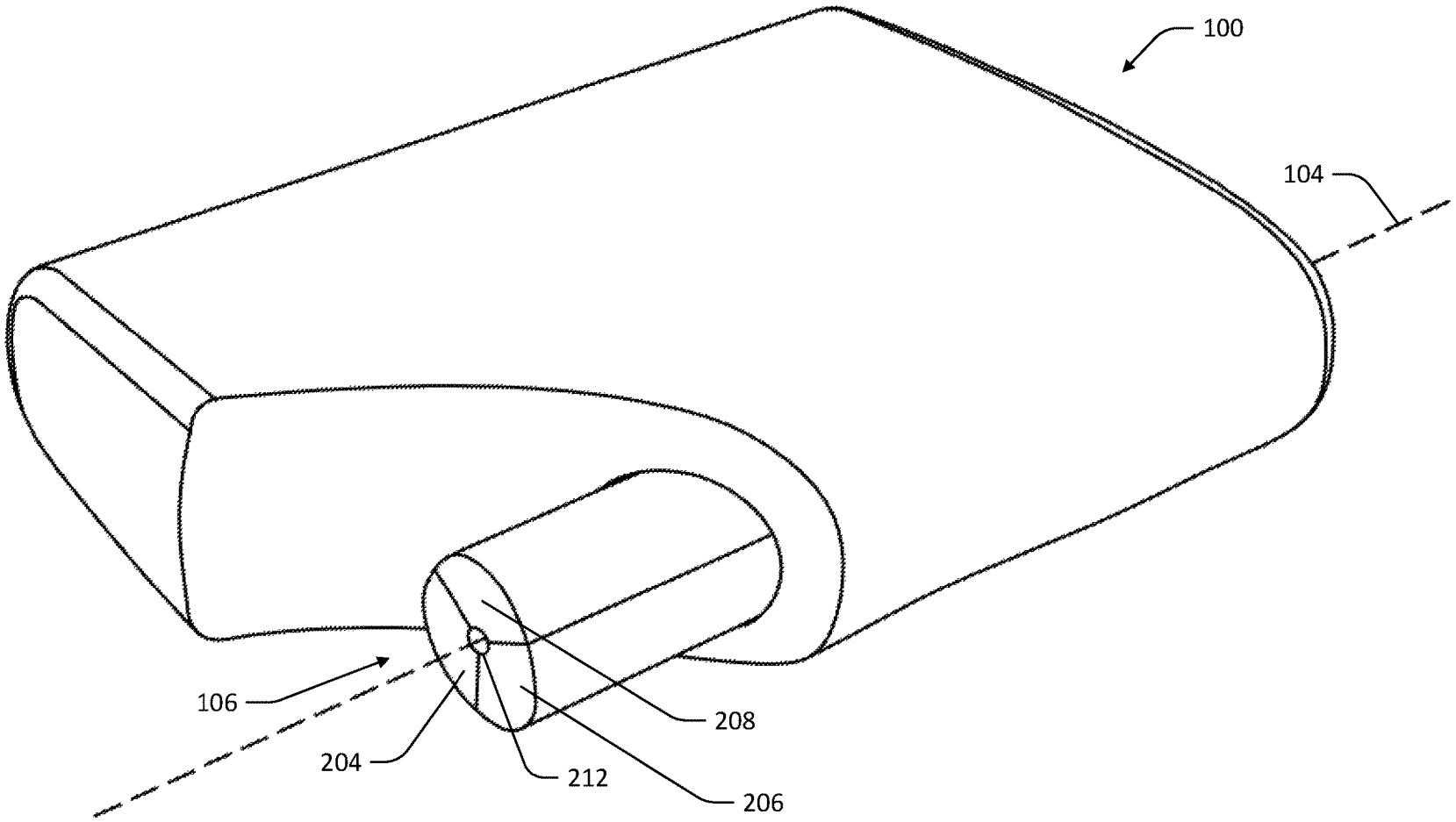
FIG. 2 is a perspective, cut-away view of an example adjustable pillow, exposing a multi-density cervical spine support.

FIG. 2 shows details of the adjustable cervical spine support 106 in a cut-away view of the pillow 100. In this embodiment, the spine support 106 is a multi-density cervical spine support that is rotatable along the major axis 104 to expose three-segments 204, 206, 208 of material with different densities (e.g., soft 204, medium 206, or firm 208) in a position configured to be directly under the user's cervical spine. The three segments 204, 206, 208 run the entire length or substantially (e.g. 80%-99%, or 85% to 97%) the entire length of the pillow 100 and are coupled to the adjustment knob 102 (See FIG. 1) at one end. A second adjustment knob (not shown) may be present on the opposite side of the pillow 100 and is also coupled to the adjustable cervical spine support 106. At the center of the adjustable cervical spine support 106, a universal joint armature 212 runs along the major axis 104 of the adjustable cervical spine support 106 to allow for adjustability while providing flexibility on a variety of mattress densities. In some embodiments, a coupling that allows rotation of the cervical spine support 106 about the major axis 104 connects the universal joint armature 212 to the adjustment knob 102. The coupling may be attached to the pillow 100 and provides support to the universal joint armature 212 while allowing the cervical spine support 106 to be rotated. For example, the coupling can be rigid and fixed to the pillow 100 such that the coupling does not rotate, while the universal joint armature 212 protrudes through an opening in the coupling. The adjustment knob 102 can be attached to the portion of the universal joint armature 212 that protrudes through the opening in the fixed coupling, thereby allowing the cervical spine support 106 to be rotated by way of the adjustment 102.

It is considered that the multi-density segments 204, 206, 208 are also of varying hardness. For example, a first section differs by at least 10% in hardness from a second segment, and the second segment differs by at least 10% from a third segment. The recited differences in hardness may range from 10% to 1000%, such as 20% to 500%, or 100% to 300%. Hardness or firmness may be measured by Indentation Load Deflection (ILD) (also known as Indentation Force Deflection, or IFD) which is determined by mechanical performance testing. In the ILD test, a material sample measuring 15" by 15" by 4" is used and the force in pounds that it takes a 50 square inch circular indenter to compress the material 1 inch (25 percent of its thickness) is recorded. For example, if the sample requires 36 lbs. of pressure to indent it 1 inch, its ILD is 36. In an embodiment, the ILD of the segments of material 204, 206, 208, may range from 8 to 100, for example, 12 to 70, or 20 to 60.

The material for the three segments and for the rest of the pillow may comprise memory foam, polyurethane foam, rubber, other types of particulate and non-particulate polymeric foam, latex, Talaly latex, natural latex, and synthetic latex, chopped foam, feathers, particulate material such as rubber, latex, Talaly latex, natural latex, and synthetic latex, or plastic beads, or natural filler material such as buckwheat husks. If particulate material or feathers are used, they would be contained in an appropriately shaped bag or other suitable container that does not interfere with the firmness of the material being felt from outside the container. In embodiments disclosed herein the material for the cervical spine support and the segments thereof is more firm than the surrounding pillow material. For example, the cervical spine support may comprise relatively firm non-viscoelastic foam, while the surrounding pillow, or at least the portion of the pillow above the cervical spine support, comprises a softer viscoelastic foam material.

In an embodiment, the adjustable cervical spine support 106 is configured to be in a cylindrical shape and fits within a hollow cylinder compartment in the interior of the pillow 100. In an embodiment, sufficient clearance for the adjustable cervical spine support 106 to rotate within the cylindrical compartment is provided. This clearance may have a range, for example, 1 micrometer to 1 cm in circumferential difference, such as 10 micrometers to 1 mm, or 100 micrometers to 5 mm. In another embodiment, there may be no clearance so long as the materials allow the adjustable cervical spine support 106 to rotate within the cylindrical compartment.

In other embodiments, either or both of the cervical spine support 106 or the hollow compartment can have irregularities in shape such that the cervical spine support 106 fits snugly within the hollow compartment when rotated to some positions and rotates freely when rotated to others. For example, the cervical spine support 106 can have protrusions and the hollow compartment can have indentations corresponding to the protrusions. When the cervical spine support 106 is rotated, the protrusions can make contact with the interior of the compartment, causing resistance due to friction, until the protrusions reach the indentations. When the protrusions of the cervical spine support 106 reach the indentations of the compartment as the cervical spine support 106 is rotated, the protrusions no longer make contact with the interior of the compartment. Thus, resistance to rotation of the cervical spine support 106 can be higher in some orientations of the cervical spine support 106 than others. This allows the cervical spine support 106 to rotate easily to one or more desired "settings" while keeping the cervical spine support 106 from rotating to another setting unless intentionally rotated by a user of the pillow 100. This may also affect the firmness of the pillow.

Additional embodiments of the adjustable cervical spine support 106 could have a minimum of two different density sections, and a maximum of four different density sections.

Figure 3:
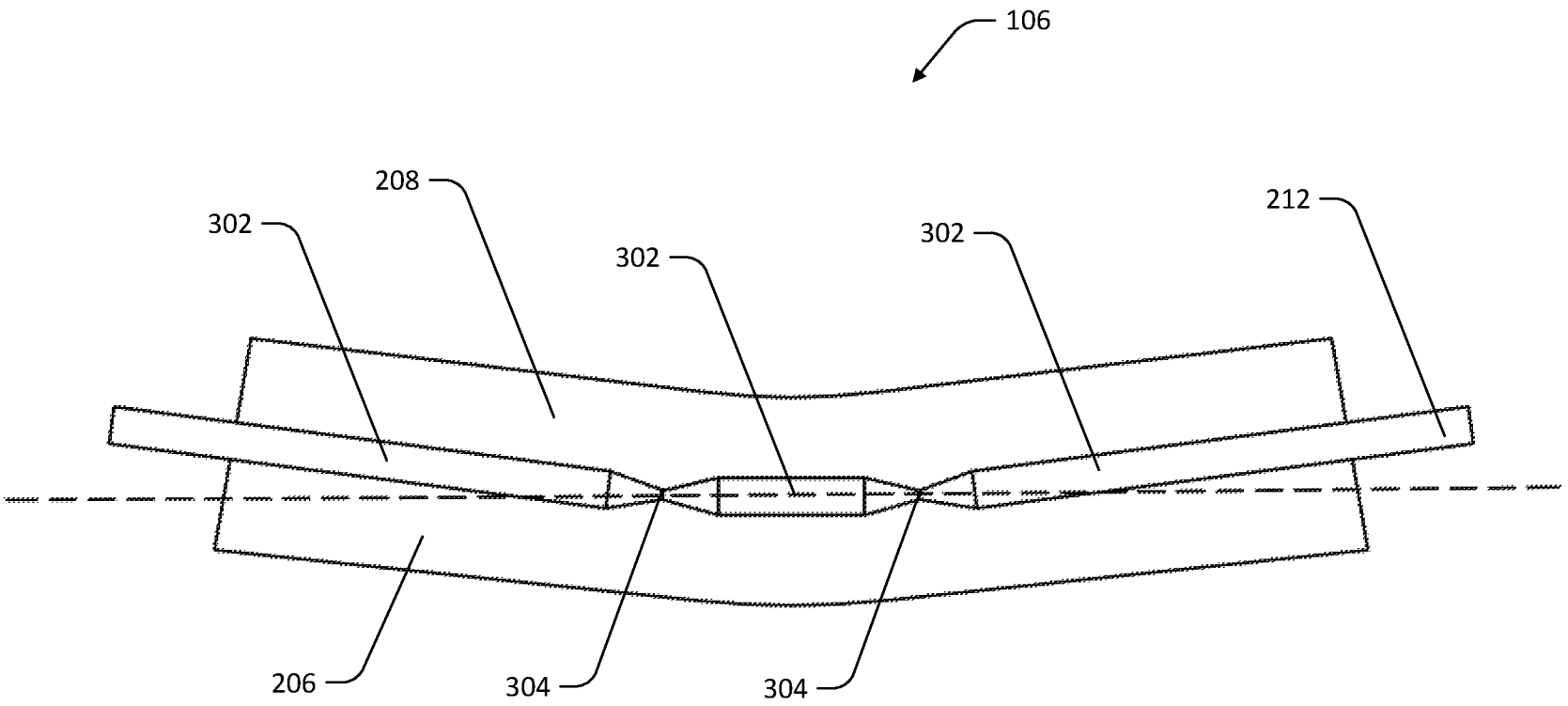
FIG. 3 is a cross-sectional view, along the major axis of an example multi-density cervical spine support in a flexed state.

FIG. 3 shows a cross-sectional view of the adjustable cervical spine support 106 in a flexed state to simulate an in-use scenario accounting for the weight of the end-user's head and cervical spine, along with the give in a mattress. In this embodiment, the universal joint armature 212 consists of three rigid elements 302, connected by two flexible elements 304. The rigid material may be hard plastic, metal, or some other rigid material. The flexible elements may, for example, be u-joint couplings or thinner, i.e., narrowed portions of the same material as the rigid material. Additional embodiments of the universal joint armature could include additional flexible and/or rigid elements. The rigid and flexible elements should be configured to allow flexibility away from the major axis 104, but provide rigidity for rotation about the major axis 104. In an embodiment, the length of the central rigid element 302 is configured to be approximately the width a user's cervical spine, e.g., 2 to 5 inches, or 2.5 to 4.5 inches, or 3 to 4 inches.

The multi-density segments 204, 206, 208 are attached to the universal joint armature 212 by an adhesive or molding process. They may also be adhered or molded to each other at their respective surfaces running along the major axis 104.

Figure 4:
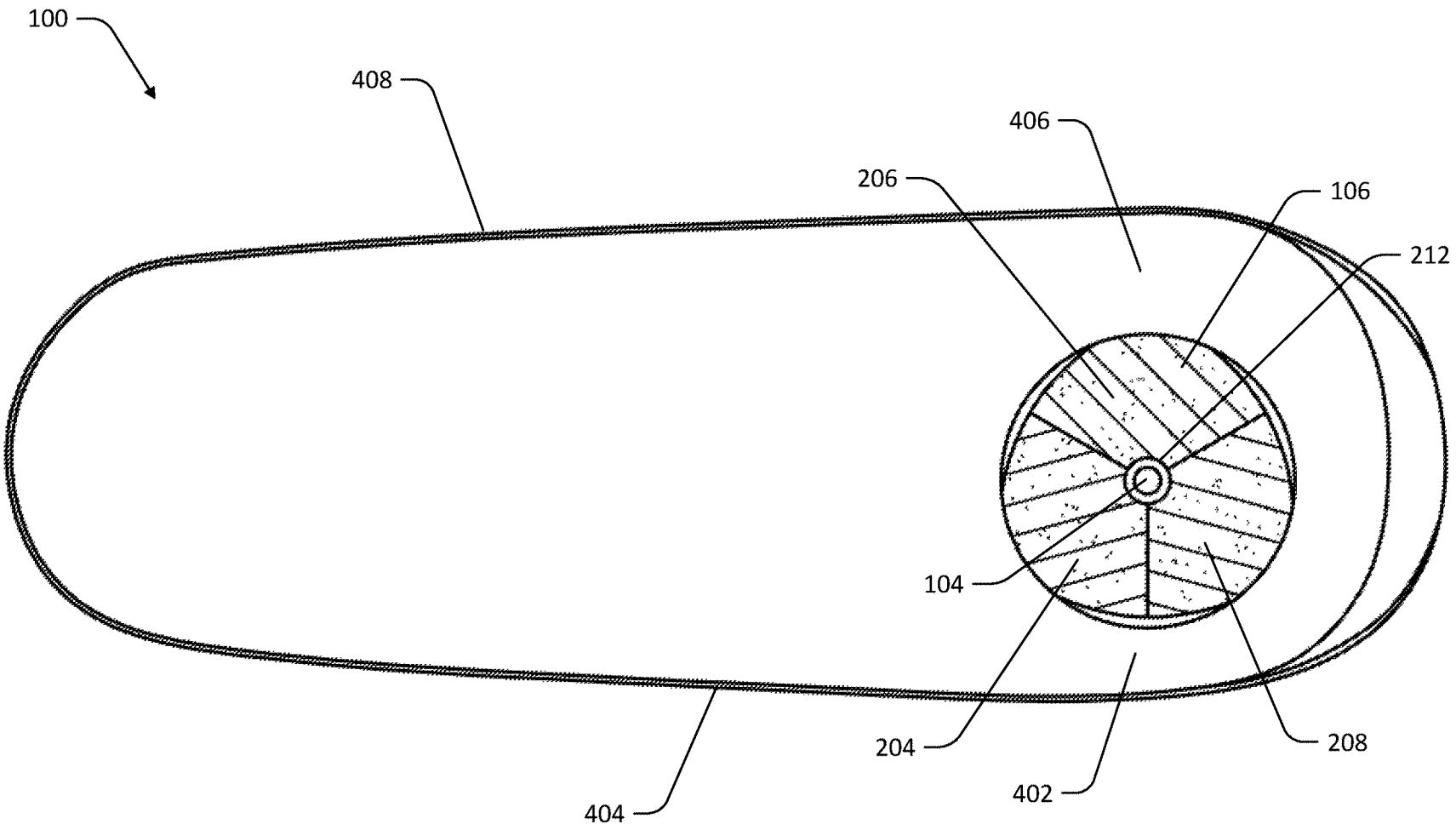
FIG. 4 is a cross-sectional side view of the adjustable pillow.

FIG. 4 shows a side view cross-section of an embodiment. This view shows the offset position of the adjustable cervical spine support 106 to create a thin section 402 on a bottom side 404 of the pillow 100, and a thicker section 406 on the top side 408 of the pillow 100, to create additional opportunities for comfort. In this embodiment, the major axis 104 is nearer a bottom side 404 of the pillow 100 than a top side 408 of the pillow 100, such as, for example the major axis 104 may be offset from the midpoint between the top and bottom sides 408, 404 of the pillow by 10% to 40% of the total thickness, such as 15% to 25% or 20% to 30%. This allows the user to further customize the pillow feel by putting their head on the top or the bottom side.

Figure 5:
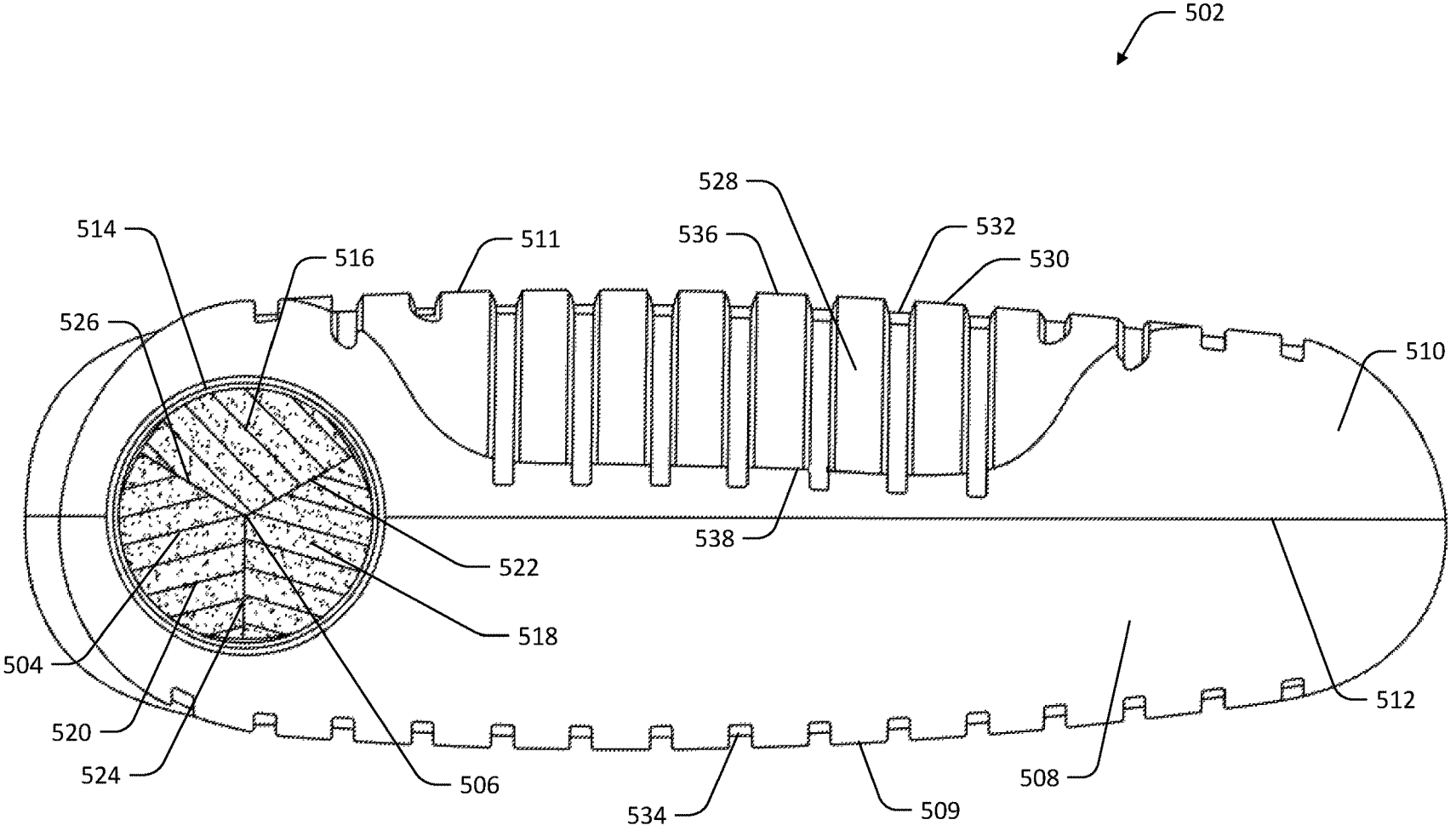
FIG. 5 is a cross-sectional side view of an additional embodiment of an adjustable pillow.

FIG. 5 shows a side view cross-section of another embodiment of an adjustable pillow 502 providing cervical alignment by way of a multi-density cervical spine support structure 504 that is positioned along a major axis 506 (extending into the page) of the pillow 502, and that can be rotated around the major axis 506. The pillow 502 comprises a lower section 508, having a lower surface 509, and an upper section 510, having an upper surface 511, wherein the lower section 508 and the upper section 510 are joined at an interface 512. In an example, the lower section 508 can be placed on a mattress or other surface for sleeping and a head of a user of the pillow 502 can rest on the upper section 510 when the pillow 502 is in use. In other embodiments, the lower section 508 and upper section 510 are integrally made, that is, they are manufactured as a single unit with a cavity for support structure 504.

In an example, the lower section 508 and the upper section 510 of the pillow 502 are joined at the interface 512 by a glue or other adhesive material. In an exemplary embodiment, when joined, the lower and upper sections 508, 510 can have a total height of between 4.5 and 6.25 inches, for example, 4.75 to 6 inches, 5 to 5.75, or 5 to 5.5 inches. The total height is measured at the tallest height of the pillow 502 with the pillow 502 laying on a flat surface. Generally, all dimensions disclosed herein are measured at the most extreme point of the dimension if not otherwise stated.

The pillow 502 can include a cavity 514 extending through the pillow 502 along the major axis 506. The multi-density cervical spine support 504 can be disposed inside the cavity 514 and can be rotated inside the cavity 514 by way of a knob (not pictured) attached to an end of the multi-density cervical spine support 504. The multi-density cervical spine support 504 comprises a plurality of segments 516, 518, 520 each having a different density. The multi-density segments 516, 518, 520 can also be of varying hardness. For example, a first segment differs by at least 10% in hardness from a second segment, and the second segment differs by at least 10% from a third segment. The recited differences in hardness may range from 10% to 1000%, such as 20% to 500%, 100% to 300%. In an embodiment, the ILD of the segments of material 516, 518, 520, may range from 8 to 100, for example, 12 to 70, or 20 to 60.

The segments 516, 518, 520 can be joined at their respective interfaces such that the multi-density cervical spine support 504 has a cylindrical shape. For example, the segment 516 can be joined to the segment 518 at an interface 522, the segment 518 can be joined to the segment 520 at an interface 524, and the segment 520 can be joined to the segment 516 at an interface 526. The segments 516, 518, 520 can be joined at the interfaces 522, 524, 526 by suitable adhesives capable of durably adhering the segments 516, 518, 520. These adhesives may be the same or different based on the chemical properties of the material being joined.

The exemplary pillow 502 further comprises a head well portion 528 that makes up at least a part of the upper section 510. In some embodiments, the head well portion 528 can make up at least a part of each of the upper section 510 and the lower section 508. The head well 528 comprises supporting surfaces 530 separated by a plurality of grooves 532. The supporting surfaces 530 can comprise a material having a density and/or a hardness that differs from a density or hardness of either or both of the lower and upper sections 508-510 of the pillow 502. The grooves 532 may function to allow airflow through the head well 528, and other parts of the pillow 502, which can keep a user of the pillow 502 cool. The lower section 508 of the pillow 502 can also have grooves 534 along the lower surface 509 of the pillow 502 in order to promote airflow over the lower surface 509. In exemplary embodiments, the head well 528 can have a height between an upper surface 536 of the support portion 528 and a lower surface 538 of the head well 528 of 0.8 to 2.7 inches, 1 to 2.5 inches, 1.25 to 2.25 inches, or 1.4 to 2 inches. The upper surface 511 of the pillow 502 includes the upper surface 536 of the head well portion 528.

The head well portion 528 is configured for a user's head and neck to rest in the supine position, with the back of the head resting against the upper surface 536 of the head well portion 528 with the neck resting over the multi-density cervical spine support 504. In another use, a user can rest the head and neck on the upper portion 510 of the pillow 502, with the neck, resting over the multi-density cervical spine support 504 and the side of the head resting against the upper surface 511 of the pillow 502. In still another use, a user can turn the pillow 502 over, and the lower surface 509 of the pillow 502 is configured for a user's head and neck to rest in the side-lying position with the neck resting over the multi-density cervical spine support 504.

Figure 6:
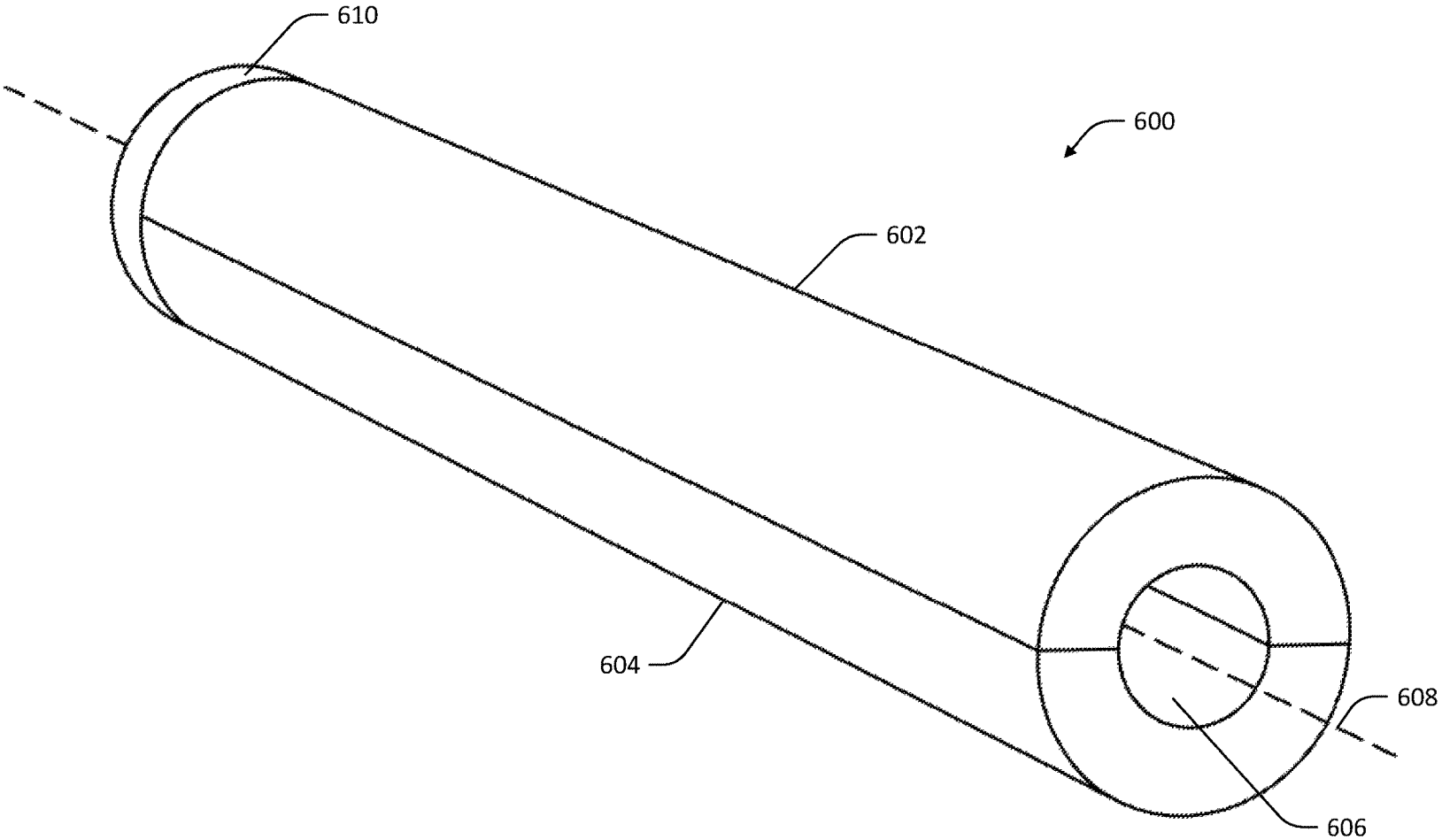
FIG. 6 is a perspective view of an example adjustable cervical spine support.

Referring now to FIG. 6, another exemplary embodiment of an adjustable cervical spine support structure 600 is illustrated. The adjustable cervical spine support 600 comprises a first portion 602 and a second portion 604. The first portion comprises a first material having a first density. The second portion 604 comprises a second material having a second density. The first portion 602 and the second portion 604 are joined such that a hollow cylindrical interior region 606 is formed that extends along a major axis 608 running through the adjustable cervical spine support 600. An end cap 610 (or knob) is connected to the terminal end of the adjustable cervical spine support structure 600. The opposite end of the adjustable cervical spine support 600 may also be connected to an end cap (not shown). The interface of the first 602 and second portion 604 and the end cap 610 may be joined together as disclosed in the prior embodiments. In an embodiment, the adjustable cervical spine support 600 is included in the adjustable pillow disclosed above instead of the adjustable cervical spine support 106 of FIGS. 2 and 4, or the multi-density cervical spine support 504 of FIG. 5.

Figure 7A:
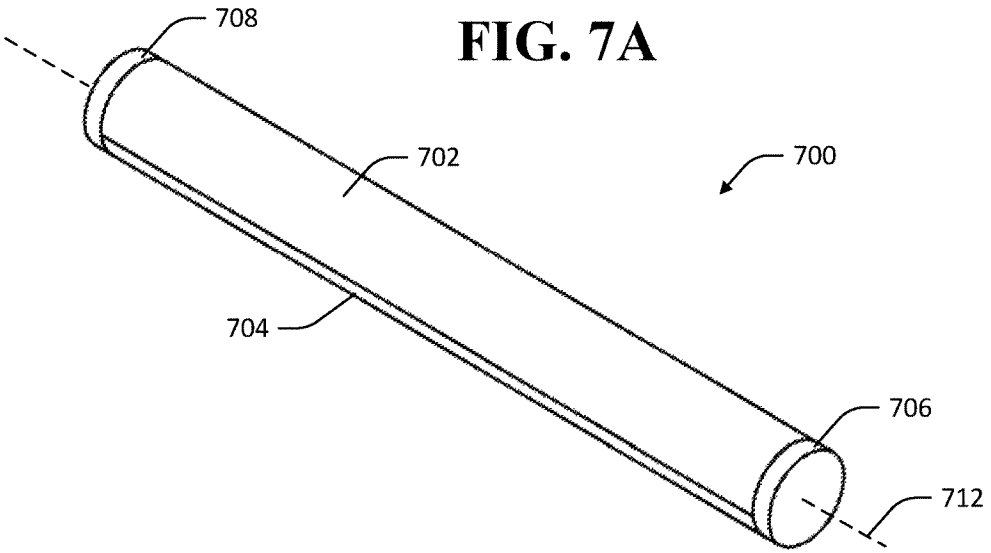
FIG. 7A-7C are views of another example adjustable cervical spine support.
Figure 7C:
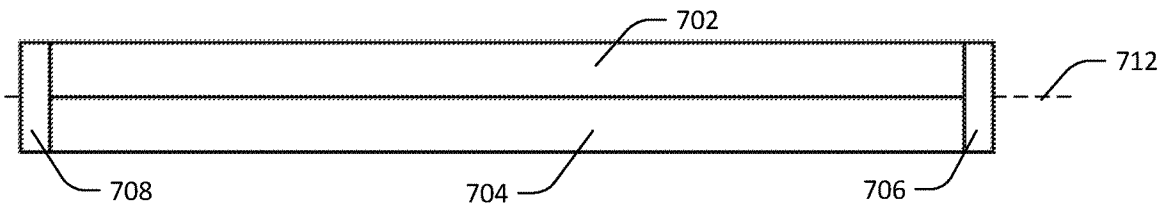
Figure 7B:
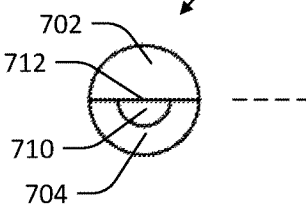

Referring now to FIGS. 7A-7C, still another exemplary embodiment of an adjustable cervical spine support structure 700 is illustrated. Referring to FIG. 7A, a perspective view of the adjustable cervical spine support 700 is shown. The adjustable cervical spine support 700 comprises a first portion 702 and a second portion 704 joined to form a substantially cylindrical shape. As in other embodiments described herein, the first portion 702 can comprise a first material having a first density, and the second portion 704 can comprise a second material having a second density. In an embodiment, the ILD of the first and second portions 702, 704 may range from 8 to 100, for example, 12 to 70, or 20 to 60. In an exemplary embodiment, the second portion 704 can comprise a softer material than the first portion 702. For example, the first portion 702 can comprise a first type of foam having an ILD of 45 and the second portion 704 can comprise a second type of foam having an ILD of 17. An end cap 706 (or knob) is connected to the terminal end of the adjustable cervical spine support 700. The opposite end of the adjustable cervical spine support 700 is also be connected to an end cap 708.

Referring to FIG. 7B, a view facing one of the terminal ends of the adjustable cervical spine support 700 is shown, wherein the end cap 706 or 708 is removed. The second portion 704 of the adjustable cervical spine support 700 has a cut-out 710 running along a major axis 712 of the adjustable cervical spine support 700. Thus, when the first portion 702 and the second portion 704 are joined, a compartment with a half cylinder hollow opening is formed that runs along the length of the adjustable cervical spine support 700 parallel to the major axis 712. The cut-out 710 may also be of different geometries and produce different hollow openings when the first and second portions 702, 704 are joined. The cut-out 710 aids in adjustability of a pillow that incorporates the adjustable cervical spine support 700. The firmness of the adjustable cervical spine support 700 depends upon both the densities of the materials comprising the first and second portions 702 and 704, and an orientation of the cut-out 710 with respect to a force applied to the adjustable cervical spine support 700 (e.g., caused by the weight of a user's head resting on a pillow incorporating the adjustable cervical spine support 700). In some embodiments, the first portion 702 and the second portion 704 comprise the same material having the same density, and the variation in firmness of the adjustable cervical spine support 700 depends entirely upon the orientation of the cut-out 710 with respect to the force applied to the adjustable cervical spine support 700. Referring to FIG. 7C, a side view of the adjustable cervical spine support 700 is illustrated.

The teachings recited herein are not limited to just pillows, but could also be employed in other types of cushions or cushion-containing furniture, such as chairs, seats used in transportation, mattresses, and hospital furniture.

In an embodiment, the adjustable cervical spine support 106 may be used outside the pillow 100, by itself, for example, as an aid for exercise or for massage. In an embodiment, the multi-density segments 204, 206, 208 may be separated in a plane perpendicular to the major axis 104, in particular, the separation may correspond to the area where flexible joints of the universal joint armature 212 are. In addition, in an embodiment, the multi-density segments 204, 206, 208 may be rotatable rather than fixed in relation to the universal joint armature 212, that is, the segments 204, 206, 208 may be joined to each other and rotate as a whole around the universal joint armature 212.

Figure 8A:
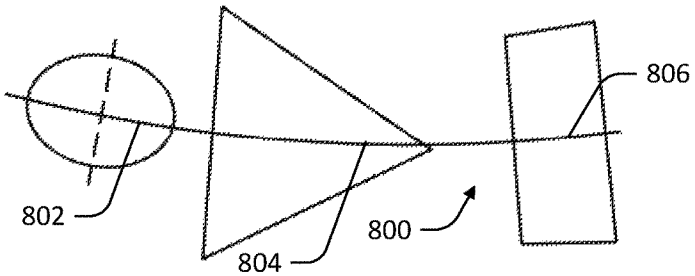
FIG. 8A-D are side view diagrams of spinal alignment and misalignment.
Figure 8B:
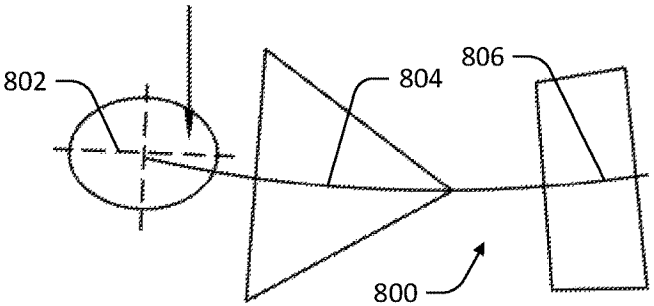
Figure 8C:
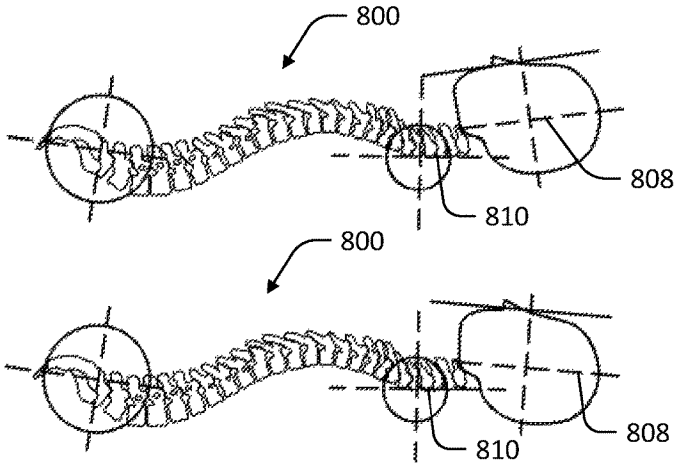
Figure 8D:
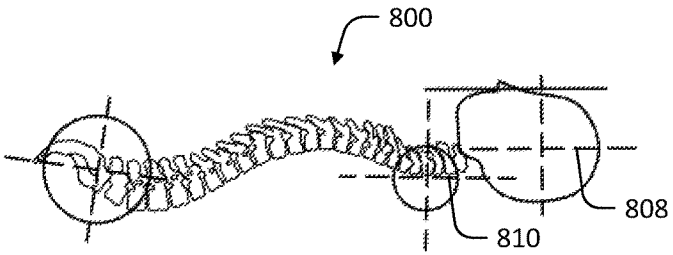

Referring now to FIGS. 8A-8D, diagrams showing exemplary alignments and misalignments of a spine of a human subject are illustrated. FIG. 8A shows an alignment of a person's spine 800 in a side-lying position wherein a continuous spline is formed by cervical 802, thoracic 804, and lumbar 806 sections of the spine 800. FIG. 8B illustrates a misalignment of the cervical section 802 of the spine 800 wherein a continuous spline running through the thoracic section 804 and the lumbar section 806 is misaligned with the cervical section 802. FIG. 8C illustrates a misalignment of head 808 and neck 810 sections of the spine 800 of the subject in a supine position in both flexion and hyperextension. FIG. 8D illustrates alignment of the head 808 and neck 810 sections of the spine 800 in the supine position, wherein the sections 808-810 are shown aligned with parallel horizontal planes. These exemplary alignment and misalignment guidelines were used to determine the various measurements in Tables 1 and 2, below.

EXAMPLES

Provided below in Tables 1 and 2 are exemplary data relating to effects of various pillow design parameters on alignment of subjects' cervical spines in connection with using a pillow constructed in accordance with embodiments of the present disclosure. The data include, for each test subject, a shoulder width, hip width, and a difference between the shoulder width and the hip width (labeled "Physiological Differential"). The data also include, for each subject, a height of the highest point of the subject's head when lying on a test bed frame with the subject's spine in alignment (labeled "Alignment Height"). This "alignment height" was determined in accordance with FIG. 8A by a neck and spine specialist from visual assessments of the test subjects. Then a height of the highest point of the subject's head was determined when lying on the test bed frame with the subject's head resting on a first prototype pillow having a total height of approximately 6 inches and a head well depth of approximately 1 inch (labeled "Prototype 1"). All data in Tables 1 and 2 are in units of inches unless otherwise noted.

The data further include a difference in height of the subject's head between the alignment height and the height for each of a variety of prototype pillows. In the side-lying position (Table 1) the subjects rested their head and neck on the lower surface 535, (i.e, the head-well portion was facing the mattress) of a pillow constructed similarly to pillow 502. The data show the difference in height when the subject's head is resting on the first pillow prototype having a height of 6 inches (labeled "Alignment Height Differential"), the difference in height when the subject's head is resting on a second pillow prototype having height of 5.5 inches (labeled "Differential (Prototype 2)"), and the difference in height when the subject's head is resting on a third pillow prototype having height of 5.25 inches (labeled "Differential (Prototype 3)"). Thus, the smaller the absolute value of the number for the "Differential" data points the closer the subject was to being in correct alignment.

In the supine position (Table 2), the subjects rested their head and neck on the upper section 510 and head well 528 of a pillow constructed similarly to pillow 502. The data include the difference in height when the subject's head is resting on the first pillow prototype having height of 6 inches and head well depth of 1 inch (labeled "Alignment Height Differential"), the difference in height when the subject's head is resting on a fourth pillow prototype having height of 5.5 inches and head well depth of 2 inches (labelled "Differential (Prototype 4)"), and the difference in height when the subject's head is resting on a fifth pillow prototype having height of 5.25 inches and head well depth of 2 inches (labeled "Differential (Prototype 5)").

TABLE 1

| Side-lying position: | | | | | | | | | |
|---|---|---|---|---|---|---|---|---|---|
| | Gender | Shoulder Width | Hip Width | Physiological Differential | Alignment Height | Prototype 1 | Alignment Height Differential | Differential (Prototype 2) | Differential (Prototype 3) |
| GP | M | 17.75 | 14 | 3.75 | 28.75 | 28.75 | 0 | −0.5 | −0.75 |
| MT | M | 17.75 | 14.5 | 3.25 | 29 | 28.875 | −0.125 | −0.625 | −0.875 |
| AD | M | 18 | 13.75 | 4.25 | 28 | 28.75 | 0.75 | 0.25 | 0 |
| RP | M | 20.5 | 14.25 | 6.25 | 28.125 | 28.5 | 0.375 | −0.125 | −0.375 |
| TS | F | 15.5 | 13.5 | 2 | 27 | 29 | 2 | 1.5 | 1.25 |
| SH | M | 16.5 | 13 | 3.5 | 28.25 | 28.875 | 0.625 | 0.125 | −0.125 |
| JC | M | 17 | 13.5 | 3.5 | 27.25 | 28.875 | 1.625 | 1.125 | 0.875 |
| BP | F | 15.875 | 14.5 | 1.375 | 27.875 | 29.125 | 1.25 | 0.75 | 0.5 |
| KM | F | 19 | 18 | 1 | 27.625 | 28.625 | 1 | 0.5 | 0.25 |
| GALA | F | 17.125 | 17.125 | 0 | 27.75 | 29 | 1.25 | 0.75 | 0.5 |
| BJ | F | 18.75 | 16 | 2.75 | 28.25 | 29.25 | 1 | 0.5 | 0.25 |
| VM | F | 16.75 | 13.75 | 3 | 27.75 | 28.75 | 1 | 0.5 | 0.25 |
| KH | F | 18.75 | 16.25 | 2.5 | 28.375 | 28.625 | 0.25 | −0.25 | −0.5 |
| LH | F | 14.375 | 13.75 | 0.625 | 28.125 | 29 | 0.875 | 0.375 | 0.125 |
| MM | F | 18.75 | 15 | 3.75 | 29.5 | 29.75 | 0.25 | −0.25 | −0.5 |
| SMS | F | 16.25 | 14.75 | 1.5 | 28 | 29.5 | 1.5 | 1 | 0.75 |
| SLS | F | 16 | 12.5 | 3.5 | 28.5 | 29.125 | 0.625 | 0.125 | −0.125 |
| KS | F | 17.75 | 15 | 2.75 | 27.875 | 28.875 | 1 | 0.5 | 0.25 |
| MA | F | 16 | 12.5 | 2.5 | 27.75 | 28.875 | 1.125 | 0.625 | 0.375 |
| JS | M | 19.25 | 13.125 | 6.125 | 28.125 | 29 | 0.875 | 0.375 | 0.125 |

TABLE 2

| Supine position: | | | | | | | | | |
|---|---|---|---|---|---|---|---|---|---|
| | Gender | Shoulder Width | Hip Width | Physiological Differential | Alignment Height | Prototype 1 | Alignment Height Differential | Differential (Prototype 4) | Differential (Prototype 5) |
| GP | M | 17.75 | 14 | 3.75 | 27.875 | 30 | 2.125 | 0.625 | 0.375 |
| MT | M | 17.75 | 14.5 | 3.25 | 27.875 | 29.625 | 1.75 | 0.25 | 0 |
| AD | M | 18 | 13.75 | 4.25 | 27.375 | 29 | 1.625 | 0.125 | −0.125 |
| RP | M | 20.5 | 14.25 | 6.25 | | | | | |
| TS | F | 15.5 | 13.5 | 2 | | | | | |
| SH | M | 16.5 | 13 | 3.5 | | | | | |
| JC | M | 17 | 13.5 | 3.5 | | | | | |
| BP | F | 15.875 | 14.5 | 1.375 | 28 | 29.875 | 1.875 | 0.375 | 0.125 |
| KM | F | 19 | 18 | 1 | 28.25 | 30 | 1.75 | 0.25 | 0 |
| GALA | F | 17.125 | 17.125 | 0 | 27.25 | 29.875 | 2.625 | 1.125 | 0.875 |
| BJ | F | 18.75 | 16 | 2.75 | 27.75 | 29.375 | 1.625 | 0.125 | −0.125 |
| VM | F | 16.75 | 13.75 | 3 | 27.75 | 29.625 | 1.875 | 0.375 | 0.125 |
| KH | F | 18.75 | 16.25 | 2.5 | 27.875 | 29.5 | 1.625 | 0.125 | −0.125 |
| LH | F | 14.375 | 13.75 | 0.625 | 28.25 | 30.125 | 1.875 | 0.375 | 0.125 |
| MM | F | 18.75 | 15 | 3.75 | 28 | 29.625 | 1.625 | 0.125 | −0.125 |
| SMS | F | 16.25 | 14.75 | 1.5 | 27.875 | 29.875 | 2 | 0.5 | 0.25 |
| SLS | F | 16 | 12.5 | 3.5 | 27.5 | 29.625 | 2.125 | 0.625 | 0.375 |
| KS | F | 17.75 | 15 | 2.75 | 28.125 | 30 | 1.875 | 0.375 | 0.125 |
| MA | F | 16 | 13.5 | 2.5 | 28 | 29.5 | 1.5 | 0 | −0.25 |
| JS | M | 19.25 | 3.125 | 16.125 | 27.875 | 29.875 | 2 | 0.5 | 0.25 |

Through the study it was determined that the greatest number of subjects were closest to alignment when using prototype pillows 3 and 5.

What has been described above includes examples of one or more embodiments. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the details description or the claims, such term is intended to be inclusive in a manner similar to the term "comprising" as "comprising" is interpreted when employed as a transitional word in a claim.

What is claimed is:

1. A cushion comprising:

a cervical spine support running along a major axis and comprising two or more segments of material with different densities or geometries also running along the major axis;

the cervical spine support being coupled in a configuration to rotate around the major axis in relation to the cushion;

wherein the two or more segments of material consist of a firm segment, a medium segment, and a soft segment, as determined by an Indentation Load Deflection test.

2. The cushion of claim 1, wherein the cervical spine support comprises a universal joint armature running along the major axis and coupled to the two or more segments of material with different densities or geometries.

3. The cushion of claim 1, wherein the universal joint armature consists of three rigid elements connected by two flexible elements.

4. The cushion of claim 1, wherein the cervical spine support is disposed within a substantially hollow cylindrical compartment in an interior of the cushion.

5. The cushion of claim 1, wherein a rotatable adjustment knob, located on an exterior side of the cushion, is coupled to the cervical spine support.

6. The cushion of claim 1, wherein the two or more segments of material are of the same geometry but of different densities.

7. The cushion of claim 1, wherein the two or more segments of material are made of foam.

8. The cushion of claim 1, wherein the major axis is 1.5 to 4 inches from a lower end of the cushion.

9. The cushion of claim 1, wherein the pillow has a total thickness of 5 to 6.25 inches from a top surface of the pillow to a bottom surface of the pillow.

10. A pillow comprising:

a cervical spine support running along a major axis and comprising two or more segments of material having different densities or geometries, the two or more segments also running along the major axis;

the cervical spine support being coupled in a configuration to rotate around the major axis in relation to the pillow;

wherein the two or more segments of the cervical spine support are joined by an adhesive.

11. The pillow of claim 10, wherein the two or more segments of the cervical spine support are joined to have a substantially cylindrical exterior shape.

12. The pillow of claim 11, wherein at least one of the two or more segments has a cut-out running along the at least one segment in a direction of the major axis, wherein a substantially hollow compartment is formed by joining of the two or more segments of the cervical spine support.

13. The pillow of claim 10, wherein a rotatable adjustment knob, located on an exterior of the pillow, is coupled to the cervical spine support.

14. The pillow of claim 10, the pillow further comprising a head well portion on a top surface of the pillow, the head well portion comprising a material having a density different from a density of a remainder of the pillow.

15. The pillow of claim 14, wherein the head well portion has a depth of 0.8 to 2.7 inches from the top surface of the pillow.

16. The pillow of claim 10, the pillow further comprising a top portion and a bottom portion, wherein the cervical spine support is disposed within a substantially hollow cylindrical compartment formed by the top portion and the bottom portion.

17. A cushion comprising:

a cervical spine support running along a major axis and comprising two or more segments of material with different densities or geometries also running along the major axis;

the cervical spine support being coupled in a configuration to rotate around the major axis in relation to the cushion;

wherein the cervical spine support comprises a universal joint armature running along the major axis and coupled to the two or more segments of material with different densities or geometries; and the universal joint armature consists of three rigid elements connected by two flexible elements.

18. The cushion of claim 17, wherein the cervical spine support is disposed within a substantially hollow cylindrical compartment in an interior of the cushion.

19. The cushion of claim 17, wherein a rotatable adjustment knob, located on an exterior side of the cushion, is coupled to the cervical spine support.

20. The cushion of claim 17, wherein the two or more segments of material are of the same geometry but of different densities.

* * * * *